US007307917B2

(12) United States Patent
Meylan et al.

(10) Patent No.: US 7,307,917 B2
(45) Date of Patent: Dec. 11, 2007

(54) MECHANISM DISPLAYING VALUES IN VARIABLE CYCLES, PARTICULARLY IN A LUNISOLAR CALENDAR

(75) Inventors: Frédéric Meylan, Neuchâtel (CH); Alain Vuilleumier, La Chaux-de-Fonds (CH)

(73) Assignee: The Swatch Group Research and Development Ltd., Marin (CH)

( * ) Notice: Subject to any disclaimer, the term of this patent is extended or adjusted under 35 U.S.C. 154(b) by 0 days.

(21) Appl. No.: 11/610,837

(22) Filed: Dec. 14, 2006

(65) Prior Publication Data

US 2007/0147176 A1 Jun. 28, 2007

(30) Foreign Application Priority Data

Dec. 23, 2005 (EP) ..... 05112952

(51) Int. Cl.
*G04B 19/24* (2006.01)

(52) U.S. Cl. ..... 368/28; 368/37

(58) Field of Classification Search ..... 368/28, 368/34–38

See application file for complete search history.

(56) References Cited

U.S. PATENT DOCUMENTS

| | | | | |
|---|---|---|---|---|
| 4,055,749 A | | 10/1977 | Kraushaar | |
| 4,541,725 A | * | 9/1985 | Baumgartner et al. | 368/37 |
| 4,674,889 A | * | 6/1987 | Klaus | 368/28 |
| 5,432,759 A | * | 7/1995 | Vaucher | 368/28 |

FOREIGN PATENT DOCUMENTS

| | | | |
|---|---|---|---|
| EP | 1 475 679 | A1 | 11/2004 |
| WO | 02/84412 | A1 | 10/2002 |
| WO | 2005/116780 | A1 | 12/2005 |

OTHER PUBLICATIONS

European Search Report issued in corresponding application No. EP 05 11 2952, completed Nov. 9, 2006.

Dershowitzh, Nachum et al., "The Chinese Calendar," Chapter 16 of Calendrical Calculations, pp. 241-264, Cambridge University Press, 1997.

Alaksen, Helmer, "The Mathematics of the Chinese Calendar." pp. 1-52, Mar. 29, 2006.

CD ROM containing Alaksen, Helmer, "Bissextile Months.nb," Mathematica Package, 1999.

* cited by examiner

*Primary Examiner*—Vit W. Miska
(74) *Attorney, Agent, or Firm*—Griffin & Szipl, P.C.

(57) ABSTRACT

The invention concerns a lunar month display mechanism, for a lunisolar calendar mechanism. The mechanism includes concentrically a plate, which determines the position of the additional month in the bissextile years. The plate is provided with a hand associated with a scale of twelve months and carries a planetary wheel permanently braked by a restraining device. The drive wheel, driven over one twelfth of a revolution at each new moon, meshes with the planetary wheel and moves the plate and hand forward. At the start of a bissextile month, the stop fingerforces the wheel to rotate overcoming the force of the restraining device while the drive wheel is rotating, such that the hand remains close to the number of the preceding month. The position of the stop finger is determined by a year cam. This mechanism can be used in particular in a Chinese calendar display.

12 Claims, 2 Drawing Sheets

Fig. 3
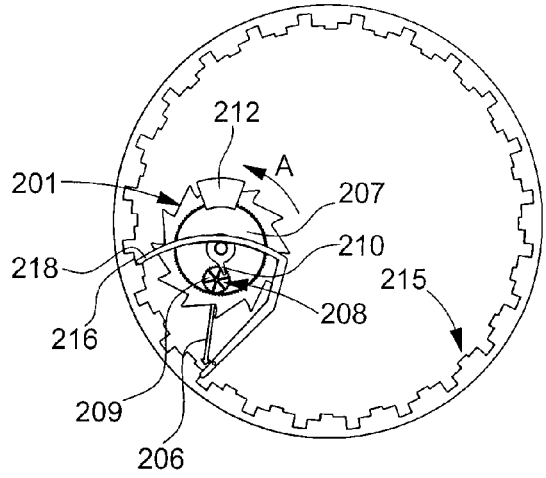
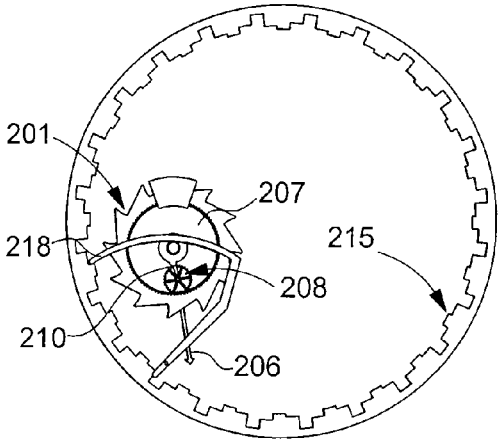
Fig. 4
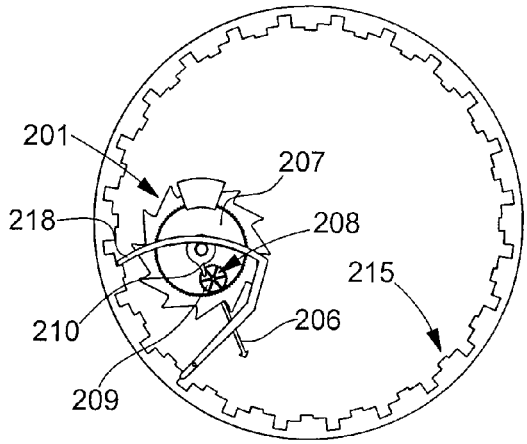
Fig. 5

MECHANISM DISPLAYING VALUES IN VARIABLE CYCLES, PARTICULARLY IN A LUNISOLAR CALENDAR

This application claims priority from European Patent Application No. 05112952.6 filed 23 Dec. 2005, the entire disclosure of which is incorporated herein by reference.

BACKGROUND OF THE INVENTION

The present invention generally concerns a mechanical device displaying cycles of discrete values of a variable on a scale of N fields, the variable being able to take either N successive ordinary values in an ordinary cycle, or at least N+1 values, including said N ordinary values and at least one additional value, in an extraordinary cycle.

This device applies particularly to the display of a lunar month in a lunisolar calendar mechanism, particularly in a timepiece. The number or the name of the current lunar month is displayed from a lunisolar mechanism such as for example the conventional Chinese calendar. A lunisolar calendar is based above all on the lunations, whose mean length is not equal to an integer number of days. Known mechanisms for displaying variables of the Julian calendar or another solar calendar cannot therefore be used for this purpose.

The Chinese calendar is still used nowadays to fix the date of certain holydays and for Chinese astrology. It is of the lunisolar type, in that it comprises lunar months that correspond to lunations, whereas Chinese years have a variable number of months in order to remain as close as possible to tropical years, i.e. to the apparent movement of the sun over the ecliptic. This calendar has a cycle of nineteen years, called the Chang cycle, which comprises almost integer numbers of lunations (235), tropical years (19) and Chinese years (19), and the origin of which is fixed so as to satisfy the historical condition fixing the Chinese New Year at the second new moon that follows the winter solstice, with rare exceptions. Each of these periods of nineteen Chinese years includes twelve ordinary years of twelve lunar months and seven bissextile years of thirteen lunar months. If one numbers the years in the Chang cycle, the bissextile years typically bear the numbers 1, 4, 7, 10, 12, 15 and 18. The additional lunar month of the bissextile years is inserted between two of the ordinary months, at a non-cyclical position which depends on astronomical data and which thus varies from one bissextile year to another. It is given the same number as the preceding month, so that the following lunar months keep the same numbers as in an ordinary year. Depending upon the time of the new moon of each New Year concerned, an ordinary year of the Chinese calendar can comprise 353, 354 or 355 days, whereas a bissextile year can comprise 383, 384 or 385 days.

For more data concerning the Chinese calendar, the reader can refer to the work by Nachum DERSHOWITZ and Edward M. REINGOLD, Calendrical Calculations, Cambridge University Press, 1997; and to the publications by Helmer ASLAKSEN: the Mathematics of the Chinese Calendar, 13 May 2004, and Bissextile Months.nb, Mathematica package, 1999, available on the site www.math-.nus.edu.sg.

It will be noted that other lunisolar calendars exist to which the present invention could apply, for example the ancient Greek calendar and the Jewish calendar, in which the bissextile years also have a cycle of nineteen years, called the Méton cycle, which is very similar to the Chang cycle.

U.S. Pat. No. 4,055,749 discloses an electronic apparatus able to display the Jewish calendar.

SUMMARY OF THE INVENTION

The present invention concerns a mechanical display device of the type indicated in the preamble hereinabove, capable of taking account of at least one additional value in addition to the N values of an ordinary cycle, the presence and the position of this additional value in an extraordinary cycle being able to be mechanically defined, for example by a cam. The invention concerns in particular a mechanical device able to display correctly the number of the current lunar month, taking account of the presence and the position of any bissextile month in the year, from a lunisolar calendar mechanism which activates the device at the end of each lunar month, i.e. at each new moon.

The display device according to the invention is characterized in that it comprises concentrically:

an indicator wheel set, driven step by step to complete one revolution per ordinary cycle and per extraordinary cycle and provided with an indicator which is associated with said scale, the indicator wheel set having a plate carrying a toothed planetary wheel which is prevented from rotating on the plate by a restraining device which is preferably of the friction type, the planetary wheel further having stop elements uniformly distributed over its circumference, a drive wheel having a first toothing, arranged to be driven through 1/N of a revolution at the end of each cycle and a second toothing which meshes with that of the planetary wheel, and a rotating stop finger able to form a stop member for at least one of the stop elements of the planetary wheel and thus to rotate the wheel against the restraining device while the plate rotates;

the device further including positioning means arranged for placing and holding the stop finger in a selected position corresponding to a field of said scale.

Preferably, the positioning means comprise a cycle cam, that has, for each cycle for a series of cycles, a shoulder whose level represents the absence or presence of an additional value in the cycle and the place of any additional value, a feeler able to abut against the corresponding shoulder of the current cycle on the cycle cam, and a transmission mechanism between the feeler and the stop finger. This transmission mechanism can be formed simply by a pivoting rack, connected to the feeler and meshed on a toothed hub of the stop finger.

When it has to be used for displaying the lunar month cycle in a lunisolar calendar mechanism, particularly in a timepiece, the device is characterized in that N has a value of twelve and in that said ordinary cycles are ordinary years comprising twelve lunar months and the extraordinary cycles are bissextile years comprising thirteen lunar months, the indicator wheel set being a lunar month wheel set that completes one revolution per year. The cycle cam is then a year cam, in which the level of each shoulder represents the absence or presence of a bissextile month in the year and the place of any bissextile month.

Thus, when the year is a bissextile year, it is possible to place the stop finger in a position such that it acts on the planetary wheel at the start of the bissextile month, so that the wheel rotates on the plate instead of remaining stationary as at the end of ordinary months. The amplitude of this rotation has to be determined by construction such that the month indicator does not pass to the next month on the month scale at that moment, but only at the end of the bissextile month, when the stop finger will have finished acting on the planetary wheel and the latter will thus remain stationary on the plate for the rest of the year. In total, the action of the stop finger has to neutralise the progression of the month indicator for one twelfth of a revolution of the drive wheel. This can occur entirely at the start of the bissextile month, but it is more advantageous if it occurs partly at the start and partly at the end of the bissextile month, as will be explained hereinafter.

BRIEF DESCRIPTION OF THE DRAWINGS

Other features and advantages of the present invention will appear from the following description, which shows by way of non-limiting example a preferred embodiment of the invention with reference to the annexed drawings, in which.

DETAILED DESCRIPTION OF ONE EMBODIMENT

Figure 1:
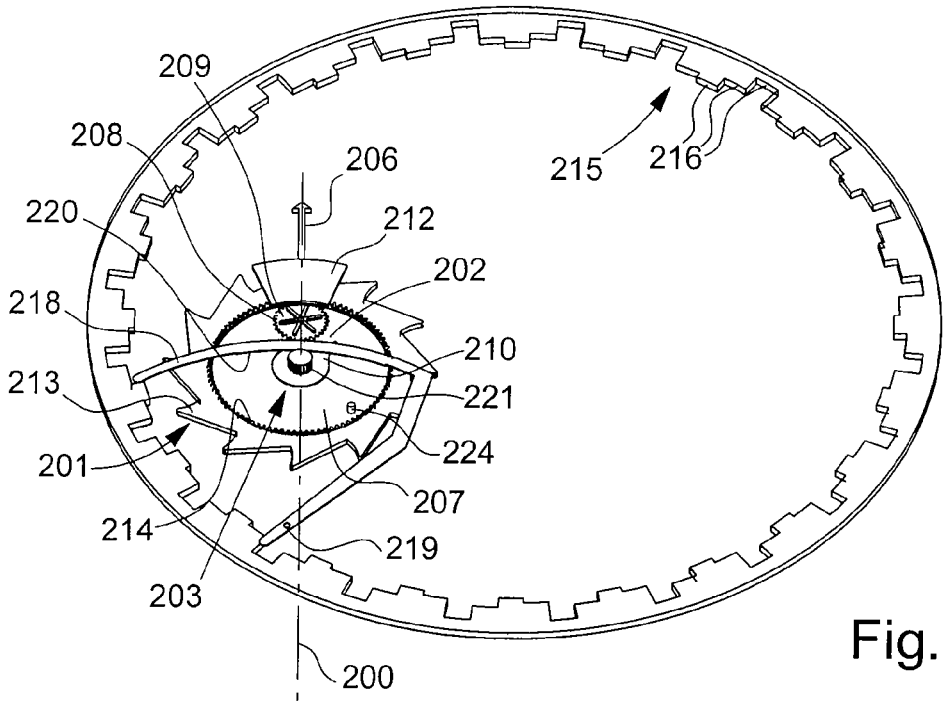
FIG. 1 is a schematic perspective bottom view of a device displaying the lunar month in the Chinese calendar, this device being able to be incorporated in a timepiece having an element able to drive the month display at each new moon.
Figure 2:
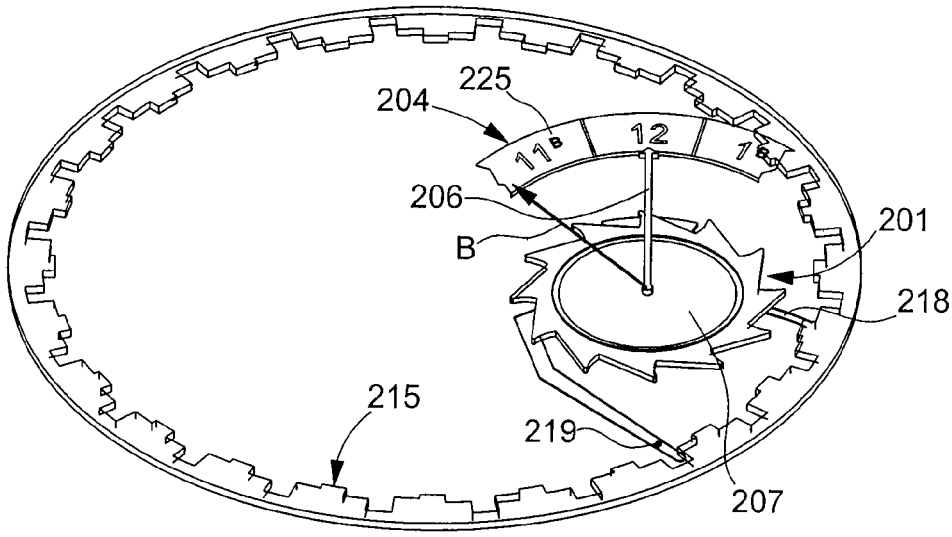
FIG. 2 is a schematic perspective view of the display device of FIG. 1, and FIGS. 3 to 5 are schematic bottom views showing different positions of the display device of FIG. 1.

The display device shown in FIGS. 1 and 2 includes three concentric parts rotating about a common axis 200 that is oriented vertically in the drawings, namely a drive wheel 201, a lunar month wheel set 202 and a stop part 203 to which is secured a hand B permanently indicating the position of the bissextile month. It should be noted in this regard that in the case of a year without a bissextile month, hand B is positioned at midday on scale 204. These three rotating parts are mounted between a support plate and a dial, which are not shown. The top face of the dial, which can be that of a calendar watch or any other timepiece, is provided with a circular month scale 204 divided in equal fields number from 1 to 12 from the Chinese New Year. An indicator, formed by a hand 206 secured to a plate 207 of month wheel set 202, points on the scale. This wheel and pinion further comprises a toothed planetary wheel 208 rotatably mounted on the bottom face of plate 207, at a distance from the centre of the plate. Planetary wheel 208 is permanently braked on plate 207 by a friction restraining device, for example a resilient washer gripped between these two elements. On the opposite side to the plate, the planetary wheel has a series of stop elements 209, six in number in the present case, which are distributed over its circumference to cooperate with a finger 210 of stop part 203. The stop elements 209 can be in the form of radial blades or teeth, for example. In the position shown in FIGS. 1 and 2, where hand 206 is pointing to the twelfth field of scale 204 and is thus indicating the last month of the year, two successive stop elements 209 follow the edge, in the shape of an arc of a circle, of a fixed locking plate 212 which accurately orientates planetary wheel 208 and prevents it from rotating at that place.

Drive wheel 201 comprises on the exterior a first toothing 213 with twelve teeth and a second toothing 214 on the interior, which meshes on planetary wheel 208. Toothing 213 enables one element of the timepiece calendar mechanism to rotate wheel 210 through one twelfth of a revolution at each new moon. If the display device is not incorporated in a timepiece, this periodic action could be performed manually.

The angular position of stop finger 210 in relation to the month scale 204 corresponds to the position of any bissextile month in the sequence of lunar months of the current year. This position is defined by a rotating year cam 215 of annular shape whose inner edge has, for each year of the lunisolar calendar, a shoulder 216 whose level (in this case the distance to the centre of the cam) represents either the absence of a bissextile month, or the place of a bissextile month among the other months of the year. Since a bissextile month is never the last of the year in the Chinese calendar, cam 215 comprises eleven levels for the bissextile months and a twelfth to represent the ordinary years. In the present example, cam 215 is provided for a series of 76 years (4×19) of the Chinese calendar, but this number is arbitrary and could be different, for example 60. After this series of years, cam 215 will be replaced by a cam representing the next series of years.

During each year, a spring holds a feeler 218 pivoting at 219 abutting against the corresponding shoulder 216 of cam 215. Feeler 218 includes a rack 220 as transmission means, meshing on a toothed hub 221 of stop part 203 so a to position finger 210 as a function of the level of said shoulder. When this level corresponds to an ordinary year, finger 210 is positioned opposite blocking plate 212, a position in which stop part 203 is moved axially downwards by a fixed ramp so that stop elements 209 of planetary wheel 208 can pass above finger 210 without interfering with the latter.

At each Chinese New Year, year cam 215 has to pivot about its centre in order to move forward one step when the display device passes from the last month of one year to the first month of the next year. This movement can be produced by a tooth 224 fixed to plate 207 and acting on a gear mechanism (not shown) which meshes with a toothing of cam 215. This mechanism must also move feeler 218 back in order to separate it from cam 215 just before the latter rotates, then release the feeler after the movement of the cam, which will set stop finger 210 in the appropriate position for the following year. The rotation of plate 207 at New Year brings hand 206 onto number 1 of the month scale.

If the year is not a bissextile year, feeler 218 returns to its end position to the left, against a shoulder of the twelfth level of cam 215, such that finger 210 is placed opposite plate 212, as explained hereinbefore, and thus has no effect during that year. At each new moon, the rotation of drive finger 201 over one twelfth of a revolution in the clockwise direction moves planetary wheel 208 and produces an equal rotation of plate 207 and hand 206, since the braked planetary wheel cannot rotate on itself. At the end of the twelfth lunar month, plate 207 will have complete one revolution and the operations described in the preceding paragraph are repeated.

If it is a bissextile year, feeler 218 is stopped less far away by cam 215 and holds finger 210 for the whole year in a position that corresponds to the number of the month preceding the bissextile month, for example as shown in FIGS. 3 to 5. More specifically, this position is such that, when hand 206 indicates the number of said month preceding the bissextile month (position shown in FIG. 3), finger 210 forms a stop member in front of the closest of stop elements 209 to the planetary wheel. At the end of that month, when drive wheel 201 completes one twelfth of a revolution in the direction indicated by arrow A and thus pushes planetary wheel 208, finger 210 restrains stop element 209 and thus forces planetary wheel 208 to rotate on itself overcoming the braking torque to which it is subjected. The rotation of plate 207 is thus greatly reduced, so that hand 206 remains in the field carrying the number of the preceding month on scale 204. FIG. 4 shows this position of the display device. Advantageously, a bissextile month sign 225 (FIG. 2) could be provided in fields 1 to 11 of the month scale, in the zone where hand 206 is placed in such circumstances. At the end of that month, the new step of the drive wheel 201 completes the rotation by a fraction of a revolution (one sixth of a revolution in the example shown) corresponding to the stop element number of planetary wheel 208 and the reduced rotation of plate 207, such that hand 206 passes to the next field of scale 204 to increment the month number by one unit reaching the position shown in FIG. 5. Finger 210 will have no effect for the rest of the year. Thus, during the thirteen lunar months of a bissextile year, drive wheel 201 moves forward by 13 twelfths of a revolution, whereas the month wheel set 202 and its hand 206 complete exactly one revolution.

Of course, the example described in detail here is only one possible embodiment of the invention among others and it could be subjected to many alterations and variants within the grasp of those skilled in the art. For example, instead of the stop finger 210 being moved axially into the position corresponding to an ordinary year, it could be resiliently mounted on stop part 203, in order that planetary wheel 208, which is prevented from rotating by blocking plate 212, pushes it back and passes it at the end of the first month of the year. The resilient hold of the finger would nonetheless have to be strong enough to overcome the braking of the planetary wheel at the start of a bissextile month.

It is possible to configure the year cam 215 in different ways in order to adapt to the rules relating to the bissextile months and years in different lunisolar calendars, which enables the principles of the present invention to be applied to Greek, Jewish or Indian calendar displays, for example.

The invention claimed is:

1. A mechanical device for displaying cycles of discrete values of a variable on a scale of N fields, the variable being able to take either N successive ordinary values in an ordinary cycle, or at least N+1 values, including said N ordinary values and at least one additional value, in an extraordinary cycle, said mechanical device including concentrically:

an indicator wheel set, driven step by step to complete one revolution per ordinary cycle and per extraordinary cycle and provided with an indicator which is associated with said scale, the indicator wheel set having a plate carrying a toothed planetary wheel which is prevented from rotating on the plate by a restraining device, the planetary wheel further having stop elements uniformly distributed over its circumference, a drive wheel having a first toothing, arranged to be driven through 1/Nth of a revolution at the end of each cycle and a second toothing which meshes with that of the planetary wheel, and a rotating stop finger able to form a stop member for at least one of the stop elements of the planetary wheel and thus to rotate the wheel against the restraining device while the plate rotates;

the device further including positioning means arranged for placing and holding the stop finger in a selected position corresponding to a field of said scale.

2. The device according to claim 1, wherein the restraining device is of the friction type.

3. The device according to claim 1 for the display of the lunar month cycle in a lunisolar calendar mechanism, particularly in a timepiece, wherein N has a value of twelve and wherein said ordinary cycles are ordinary years including twelve lunar months and the extraordinary cycles are bissextile years including thirteen lunar months, the indicator wheel set being a lunar month wheel that completes one revolution per year.

4. The device according to claim 1, wherein the stop finger has an inactive position, in which it does not interfere with the stop elements of the planetary wheel.

5. The device according to claim 4, wherein, in the inactive position, the stop finger is shifted in the direction of the rotational axis thereof in relation to the other positions thereof.

6. The device according to claim 4, wherein the inactive position of the stop finger is that which corresponds to the last field on said scale.

7. The device according to claim 1, wherein the positioning means include a cycle cam, having, for each cycle of a series of cycles, a shoulder the level of which represents the absence or presence of an additional value in the cycle and the place of any additional value, a feeler able to abut against the corresponding shoulder of the current cycle on the cycle cam, and a transmission mechanism between the sensor and the stop finger.

8. The device according to claim 7, wherein said transmission mechanism is formed by a pivoting rack, connected to the feeler and meshed on the toothed hub of the stop finger.

9. The device according to claim 3, wherein the cycle cam is a year cam, wherein the level of each shoulder represents the absence or presence of a bissextile month in the year and the place of any bissextile month.

10. The device according to claim 7, wherein the year cam is removable and can be replaced by a cam corresponding to another series of years.

11. The device according to claim 2 for the display of the lunar month cycle in a lunisolar calendar mechanism, particularly in a timepiece, wherein N has a value of twelve and wherein said ordinary cycles are ordinary years including twelve lunar months and the extraordinary cycles are bissextile years including thirteen lunar months, the indicator wheel set being a lunar month wheel that completes one revolution per year.

12. The device according to claim 7, wherein the cycle cam is a year cam, wherein the level of each shoulder represents the absence or presence of a bissextile month in the year and the place of any bissextile month.

* * * * *